US005636783A

United States Patent [19]

Preston

[11] Patent Number: 5,636,783

[45] Date of Patent: Jun. 10, 1997

[54] VARIETY PACK BREAD

[76] Inventor: Tracey Preston, 757 Mt. Prospect Ave., Newark, N.J. 07104

[21] Appl. No.: 577,690

[22] Filed: Dec. 22, 1995

[51] Int. Cl.[6] ..... B65D 33/16

[52] U.S. Cl. ..... 229/87.09; 383/37; 383/64

[58] Field of Search ..... 229/87.09; 383/64, 383/37

[56] References Cited

U.S. PATENT DOCUMENTS 2,994,469 8/1961 Troup et al. ..... 383/64

FOREIGN PATENT DOCUMENTS 7403138 9/1975 Netherlands ..... 229/87.09

*Primary Examiner*—Stephen P. Garbe

[57] ABSTRACT

The present invention relates to a new and improved packing system for creating a variety pack loaf of bread. In this system, groups of sliced bread are individually packaged and stored in larger package. Thus, the user can taylor a loaf of bread to their individual needs. In it broadest context, the present invention includes a plurality of smaller packages adapted to hold a number of individual slices of bread and a larger package adapted to hold each of the plurality of smaller packages.

1 Claim, 3 Drawing Sheets

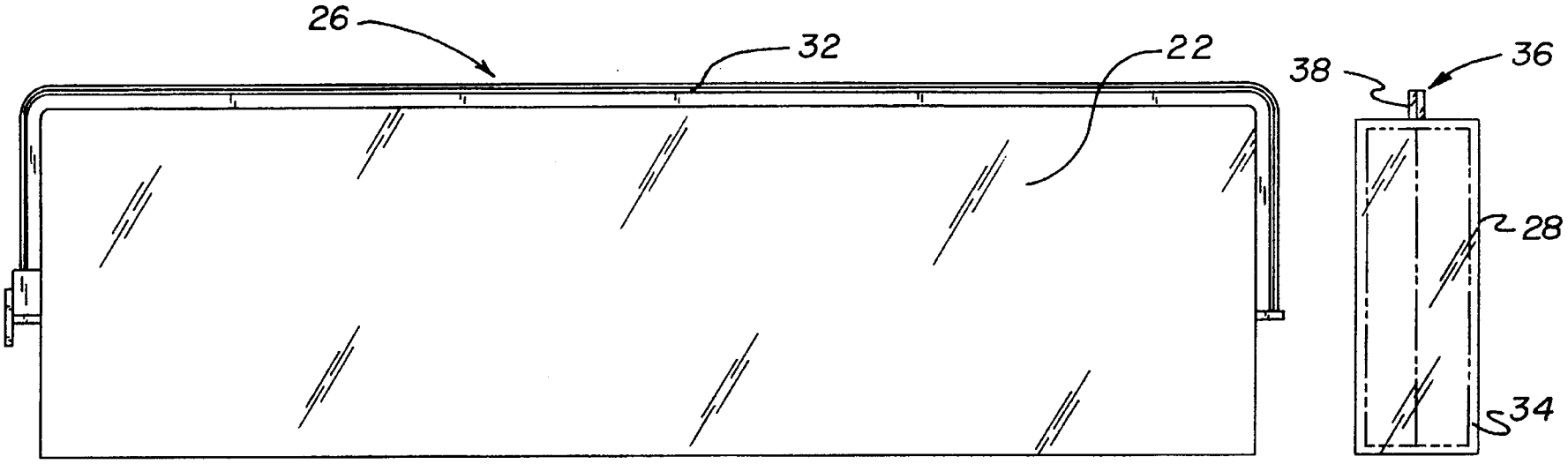
FIG. 3
FIG. 2
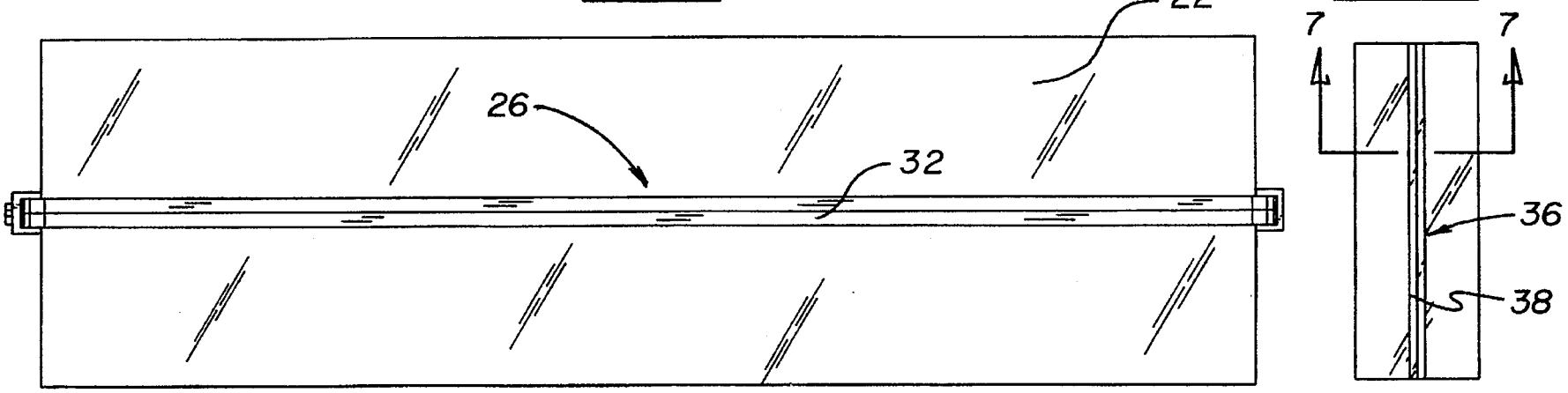
FIG. 5
FIG. 4

VARIETY PACK BREAD

BACKGROUND OF THE INVENTION

1. Field of the Invention

The present invention relates to variety pack bread and more particularly pertains to a means for creating a variety pack bread.

2. Description of the Prior Art

The use of bread packages is known in the prior art. More specifically, bread packages heretofore devised and utilized for the purpose of bread packages are known to consist basically of familiar, expected, and obvious structural configurations, notwithstanding the myriad of designs encompassed by the crowded prior art which has been developed for the fulfillment of countless objectives and requirements.

The prior art illustrates in U.S. Pat. No. 4,709,851 to Vanasse; U.S. Pat. No. 3,469,999 to Meyers; 3,432,310 to Weeks; U.S. Pat. No. 3,428,240 to Morris; and U.S. Pat. No. 4,457,124 to Hartmann various packing means for bread products.

In this respect, the variety pack bread according to the present invention substantially departs from the conventional concepts and designs of the prior art, and in doing so provides an apparatus primarily developed for the purpose of creating a variety pack bread.

Therefore, it can be appreciated that there exists a continuing need for new and improved variety pack bread which can be used for creating a variety pack bread. In this regard, the present invention substantially fulfills this need.

SUMMARY OF THE INVENTION

In view of the foregoing disadvantages inherent in the known types of bread packages now present in the prior art, the present invention provides an improved variety pack bread. As such, the general purpose of the present invention, which will be described subsequently in greater detail, is to provide a new and improved variety pack bread and method which has all the advantages of the prior art and none of the disadvantages.

To attain this, the present invention essentially comprises a packing system for creating a variety pack loaf of bread, wherein groups of sliced bread can individually packaged and stored in larger package. The invention comprises a major rectangular compartment having a major interior area, a first end, a second end, a bottom and a top, wherein the top has an intermediate extent. The major rectangular compartment is constructed from a pliable, transparent material. A major opening extends along the intermediate extent of the top of the compartment. This major rectangular compartment is long enough to accommodate a loaf of bread. A major zipper type closure means extends along the intermediate extent of the top of the rectangular compartment. This major closure means functions to selectively seal the major opening or unseal the major opening and thereby permit access to the major interior area of the major rectangular compartment. Furthermore, the present invention comprises a plurality of minor rectangular compartments, with each of the minor rectangular compartment having a minor interior area, a first end, a second end, a bottom and a top, with the top having an intermediate extent. A minor opening is formed along the intermediate extent of each of the compartments. The minor rectangular compartments are each dimensioned to be placed within the major rectangular compartment such that each of the minor openings are positioned perpendicular to the major opening. Furthermore, each of the minor compartments constructed from a pliable transparent material. A minor zipper type closure means is associated with each of the plurality of minor rectangular compartments. This minor closure means functions to selectively seal the minor opening or unseal the minor opening and thereby permit access to the minor interior area. This minor interior area is specifically dimensioned to receive a number of slices of bread.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved variety pack bread which have all the advantages of the prior art bread packages and none of the disadvantages.

It is another object of the present invention to provide new and improved variety pack bread which may be easily and efficiently manufactured and marketed.

It is further object of the present invention to provide new and improved variety pack bread which are of durable and reliable constructions.

An even further object of the present invention is to provide new and improved variety pack bread which are susceptible of a low cost of manufacture with regard to both materials and labor, and which accordingly are then susceptible of low prices of sale to the consuming public, thereby making such variety pack bread economically available to the buying public.

Still yet another object of the present invention is to provide new and improved variety pack bread which provide in the apparatuses and methods of the prior art some of the advantages thereof, while simultaneously overcoming some of the disadvantages normally associated therewith.

Even still another object of the present invention is to provide a means for creating a variety pack bread.

Lastly, it is an object of the present invention to provide new and improved packing system for creating a variety pack loaf of bread. In this system, groups of sliced bread are individually packaged and stored in larger package. Thus, the user can taylor a loaf of bread to their individual needs. In it broadest context, the present invention includes a plurality of smaller packages adapted to hold a number of individual slices of bread and a larger package adapted to hold each of the plurality of smaller packages.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side elevational view of the major compartment.

FIG. 3 is a end view of one of the minor compartments.

FIG. 4 is a top view of the major compartment.

FIG. 5 is a top view of one of the minor compartments.

The same reference numerals refer to the same parts through the various FIGS.

DESCRIPTION OF THE PREFERRED EMBODIMENT

Figure 1:
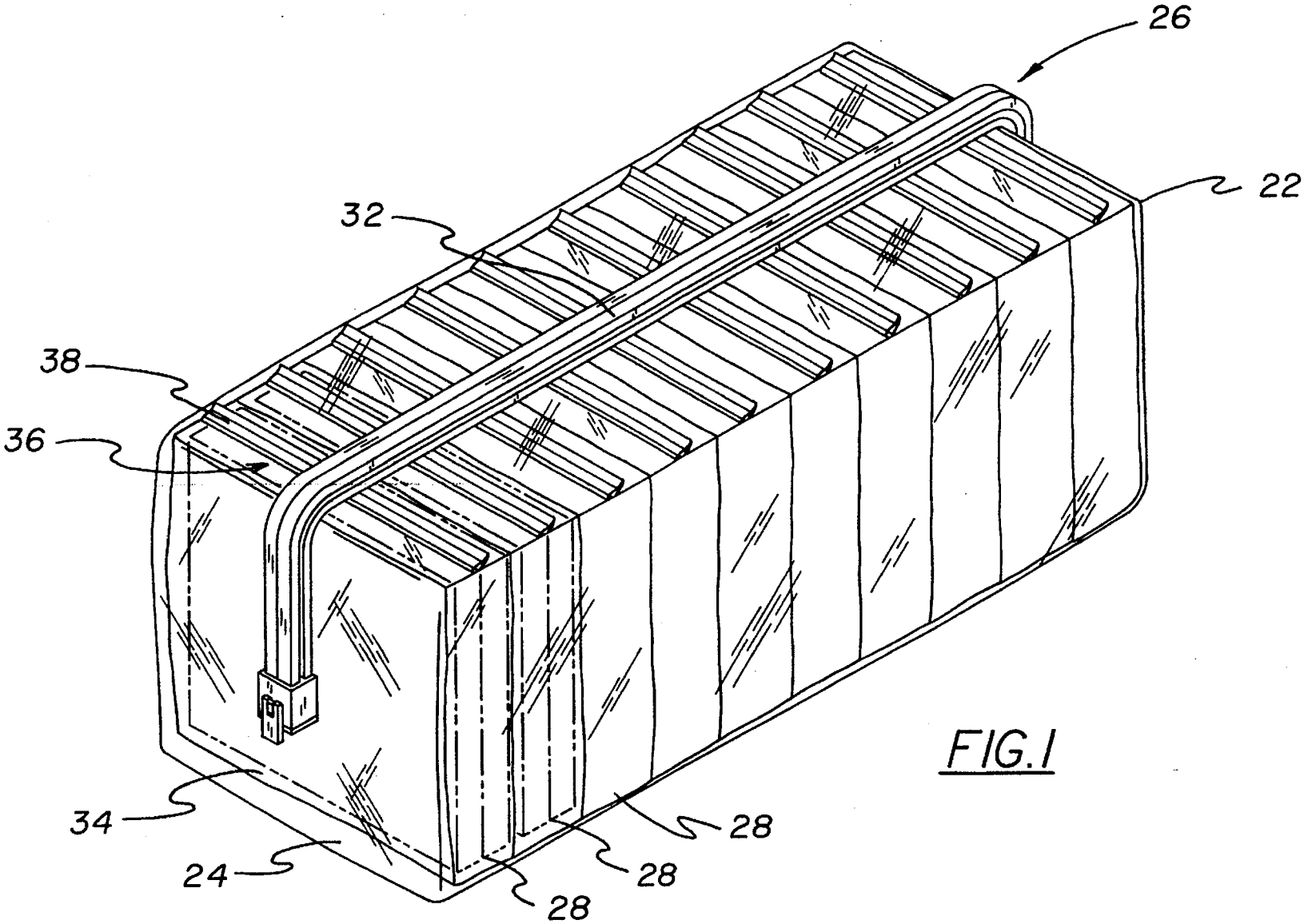
FIG. 1 is a perspective view of the preferred embodiment of the variety pack bread constructed in accordance with the principles of the present invention.
Figure 6:
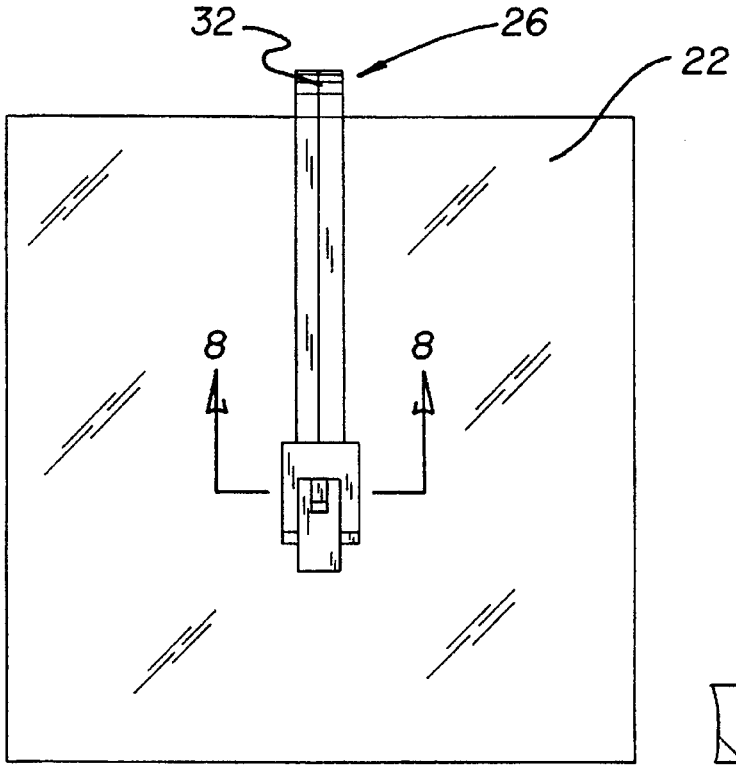
FIG. 6 is a view of the zipper type closure of the major compartment.
Figure 7:
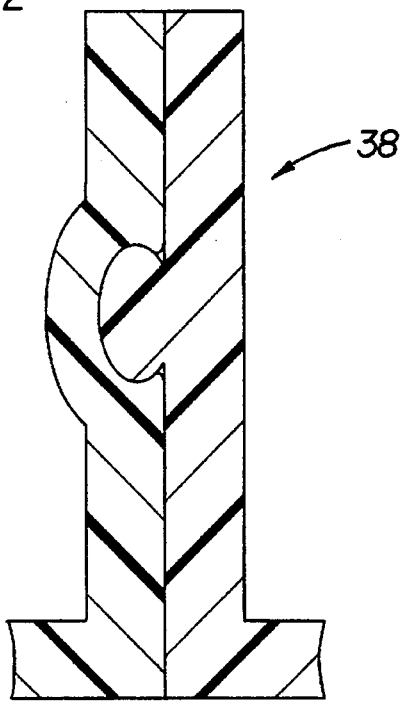
FIG. 7 is a view taken along line 7—7 of FIG. 5.
Figure 8:
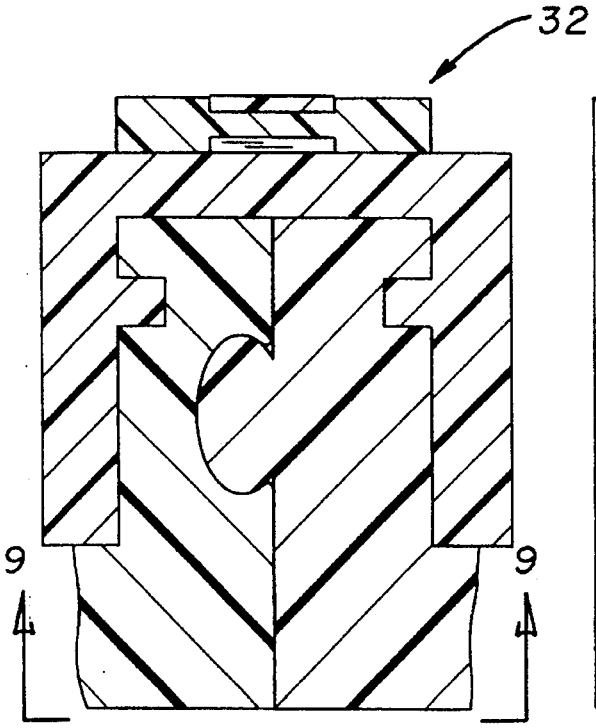
FIG. 8 is a view taken along line 8—8 of FIG. 6.
Figure 9:
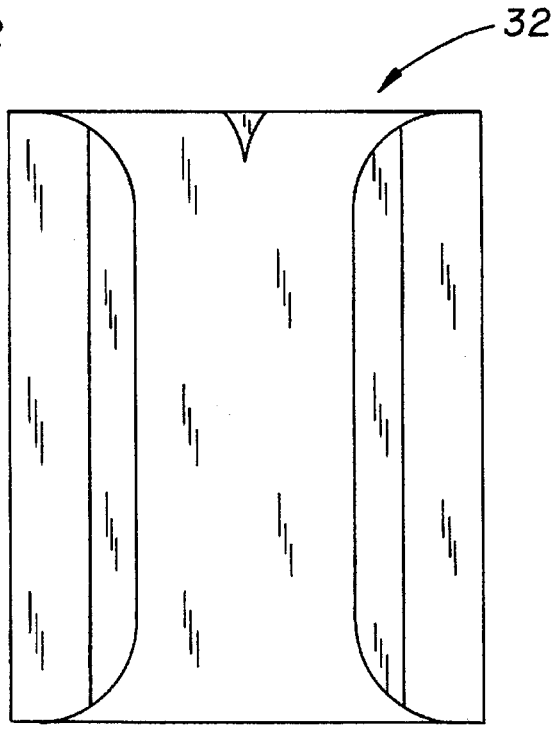
FIG. 9 is a view of one of the minor compartments.

With reference now to the drawings, and in particular to FIG. 1 thereof, the preferred embodiment of the new and improved variety pack bread embodying the principles and concepts of the present invention and generally designated by the reference numeral 10 will be described.

The present invention relates to a packing system for creating a variety pack loaf of bread. In this system, groups of sliced bread are individually packaged and stored in larger package. Thus, the user can taylor a loaf of bread to their individual needs. In it broadest context, the present invention includes a plurality of smaller packages adapted to hold a number of individual slices of bread and a larger package adapted to hold each of the plurality of smaller packages. The details as to the various components of the present invention, an the manner in which they interrelate, will be described in greater detail hereinafter.

The larger package, or major rectangular compartment 22, is defined by a major interior area 24, a first end, a second end, a bottom and a top which has an intermediate extent. This major rectangular compartment 22 is constructed from a pliable, transparent material such as a lightweight plastic. Furthermore, a major opening 26 extends along the intermediate extent of the top of the compartment and extends downwardly into the ends, as shown in FIG. 1. The details as to the closure means for the major opening 26 will be described in greater detail hereinafter. The purpose of the major compartment is to hold a number of smaller, or minor, packages. The minor packages 28 together making an entire loaf of bread. Thus, the major rectangular compartment 22, in the preferred embodiment, is long enough to accommodate a standard size loaf of bread.

The major opening 26 is sealed or opened by way of a major zipper type closure means 32. This closure means extends along the intermediate extent of the top of the rectangular compartment, and functions to selectively seal the major opening 26 or unseal the major opening 26 and thereby permit access to the major interior area 24 of the major rectangular compartment 22. Specifically, the closure means can take the form of a tongue in groove type zipper; with one half of the opening having a tongue which friction fits into a recess within the opposite half. A slidable zipper, which rides upon the outer portion of the tongue and groove, is moved to selectively bring the two sides of the opening into or out of engagement with one another.

As indicated above, the system also employs a plurality of minor rectangular compartments 28. Each of these compartments is defined by a minor interior area 34, a first end, a second end, a bottom and a top which has an intermediate extent. A minor opening 36 is formed along the intermediate extent of each of the minor compartments. As with the major compartment, each of the minor compartments is constructed from a light weight plastic, or some other suitable pliable and transparent material. Each of the minor rectangular compartments 28 is dimensioned to be placed within the major rectangular compartment 22 such that each of the minor opening 36 are positioned perpendicular to the major opening 26. Furthermore, the two compartments are oriented such the bottom of the minor compartments rest upon interior bottom surface of the major interior area 24. In the preferred embodiment each of the minor compartments 28 is dimensioned to receive two slices of standard size bread. However, other embodiments can employ minor compartments which are dimensioned to receive three, four, five, six or even eight slices of bread.

The minor zipper type closure means 38 associated with each of the plurality of minor rectangular compartments is similar in construction to the major zipper type closure means. More specifically, the minor closure means functions to selectively seal the minor opening 36 or unseal the minor opening 36 and thereby permit access to the minor interior area 34. This closure means can again take the form of a tongue in groove type zipper arrangement; one half of the minor opening 36 having a tongue which is adapted to be friction fit into the groove of the opposite half.

Thus, what has been described is a system which enables a user to custom make a loaf of bread. This is achieved as follows. First, a user selects the various types of bread to use (e.g. white, rye, wheat, pumpernickel, poppyseed etc). Then groups of these breads are placed into individual minor compartments. For example, two slices of white can be placed into a minor compartment dimensioned to receive two slices, three slices of rye can be placed into a minor compartment dimensioned to receive three slices, and four slices of pumpernickel can be placed into a minor compartment dimensioned to receive four slices. Next, each of these minor compartments is sealed and placed into the major interior area of the major compartment. The major compartment is then sealed. As such, the user has a standard size loaf of bread which is taylor made to his specific needs. Although in the previous example a number of different sized minor compartments are employed, a loaf can also be created which employs a number of same sized compartments (e.g. 10 compartments each adapted to receive two slices of bread).

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A packing system for creating a variety pack loaf of bread, wherein groups of sliced bread can be individually packaged and stored in a larger package, the packing system comprising in combination:

a major rectangular compartment having a major interior area, a first end, a second end, a bottom and a top, the top having an intermediate extent, the major rectangular compartment constructed from a pliable, transparent material, a major opening extending along the intermediate extent of the top of the compartment and extending downwardly into the ends, the major rectangular compartment being long enough to accommodate a loaf of bread;

a major tongue in groove zipper type closure means extending along the intermediate extent of the top of the rectangular compartment, the major closure means functioning to selectively seal the major opening or unseal the major opening and thereby permit access to the major interior area of the major rectangular compartment;

a plurality of minor rectangular compartments, each of the minor rectangular components having a minor interior area, a first end, a second end, a bottom and a top, the top having an intermediate extent, a minor opening formed along the intermediate extent, the minor rectangular compartments each dimensioned to be placed within the major rectangular compartment such that each of the minor openings are positioned perpendicular to the major opening, each of the minor compartments constructed from a pliable transparent material;

a minor tongue in groove zipper type closure means associated with each of the plurality of minor rectangular compartments, the minor closure means functioning to selectively seal the minor opening or unseal the minor opening and thereby permit access to the minor interior area, the minor interior area being specifically dimensioned to receive a number of slices of bread.

* * * * *